United States Patent [19]

Stillerud et al.

[11] 3,947,151

[45] Mar. 30, 1976

[54] HOLLOW HUB MARINE PROPELLER WITH ANTICAVITATION GROOVE

[76] Inventors: Karl Gustav Herman Stillerud; Allan Ohman, both of c/o AB Volvo Penta P.O. Box 136, S-751 04 Uppsala, Sweden

[22] Filed: Dec. 6, 1974

[21] Appl. No.: 530,160

[30] Foreign Application Priority Data

Dec. 19, 1973 Sweden ..... 7317119

[52] U.S. Cl. ..... 416/93 A; 115/17

[51] Int. Cl.[2] ..... B63H 1/16

[58] Field of Search ..... 115/34 R, 35, 17, 18 R; 416/93, 93 M

[56] References Cited

UNITED STATES PATENTS

| | | | |
|---|---|---|---|
| 2,213,609 | 9/1940 | Ronning | 416/93 M |
| 2,948,252 | 8/1960 | Alexander, Jr. | 115/34 R |
| 3,356,151 | 12/1967 | Strang | 416/93 M |
| 3,542,487 | 11/1970 | Knuth | 416/93 M |
| 3,589,833 | 6/1971 | Lancioni | 416/93 M |
| 3,640,642 | 2/1972 | Kress et al. | 416/93 M |
| 3,788,267 | 1/1974 | Strong | 416/93 M |

*Primary Examiner*—Trygve M. Blix
*Assistant Examiner*—Stuart M. Goldstein
*Attorney, Agent, or Firm*—George H. Baldwin; Arthur G. Yeager

[57] ABSTRACT

This invention relates to hollow hub marine propellers provided with an external groove girdling the hub disposed between the propeller blades and the rear hub opening. The walls of the groove or annular cavity do not extend outwardly of the hub and thereby offer minimal water resistance. The groove serves to minimize forward migration of exhaust gas issuing from the rear end of the hub, thus to minimize blade cavitation.

16 Claims, 5 Drawing Figures

HOLLOW HUB MARINE PROPELLER WITH ANTICAVITATION GROOVE

This invention relates to an anticavation device for marine propellers having a hub with a hollow interior passage terminating at a rearwardly located discharge opening for passage of exhaust gases into the water and with a plurality of blades extending forwardly of this opening.

It is known before that, for instance, outboard motors or drive legs of inboard-outboard drive units, have the exhaust gas discharge through a passage in the propeller hub, as this method provides for an improved and safer silencing of the exhaust gas noises as well as for an improved propeller efficiency. To achieve the latter object it is also possible to force a flow of air instead of the exhaust gases through the propeller hub.

There are, however, also disadvantages associated with this method of discharging the exhaust gases through the propeller hub. During operation through the water, under certain circumstances, especially when turning the outboard motor for swinging the boat, when running the boat against heavy waves and when forcing the boat from displacement to planing position, there is developed an exhaust gas migration forwardly along the hub to the front face of the propeller blades, thereby causing conditions of cavitation.

Various constructions have been devised in efforts to thwart the undesirable action and reference may be had to the disclosures of U.S. Pat. Nos. 2,948,252; 3,092,185; 3,102,506; 3,246,698; 3,356,151; 3,467,051; 3,554,665; 3,587,510; 3,589,833; and 3,765,370. Each of these patents discloses means for passing air or exhaust gas outwardly from a propeller hub, and some of the arrangements are more or less effective to reduce cavitation. Those arrangements which seem more effective in this respect tend to have other undesirable effects, particularly reduced efficiency. Typically, there is a loss of efficiency caused by various projecting members or portions used in the constructions which are intended to have an anticavitation effect, and these projecting members or portions of course constitute a resistance against the water when propelling the boat. Among other patents showing propeller hub exhausts are U.S. Pat. No. 2,213,612 — Ronning; U.S. Pat. No. 3,279,415 — Kiekhaefer; U.S. Pat. No. 3,431,882 — Irgens; U.S. Pat. No. 3,587,510 — Shimanckas and U.S. Pat. No. 3,765,370 — Shimanckas.

A smooth hub gives optimum possibilities to have high efficiency of the propulsion unit, but this efficiency has hitherto been reduced when the cavitation problem has not been taken into consideration.

The object of the present invention is to solve this problem, so that an anticavitation device is provided, which device minimizes any speed or efficiency reducing properties and is comparable with a smooth propeller hub as to drag while also reducing cavitation.

According to the invention there is made on the outside of the propeller hub, or of an attachment secured to the rear end of the hub, one or more axially spaced annular grooves or one or more axially spaced series of annularly disposed recesses, these grooves or recesses being located between the propeller blades and the exhaust gas discharge opening.

The novel features which are believed to be characteristic of this invention are set forth with particularlity in the appended claims. The invention itself, however, both as to its organization and method of operation, together with further objects and advantages thereof, may best be understood by reference to the following description taken in connection with the accompanying drawings, in which:

Figure 1:
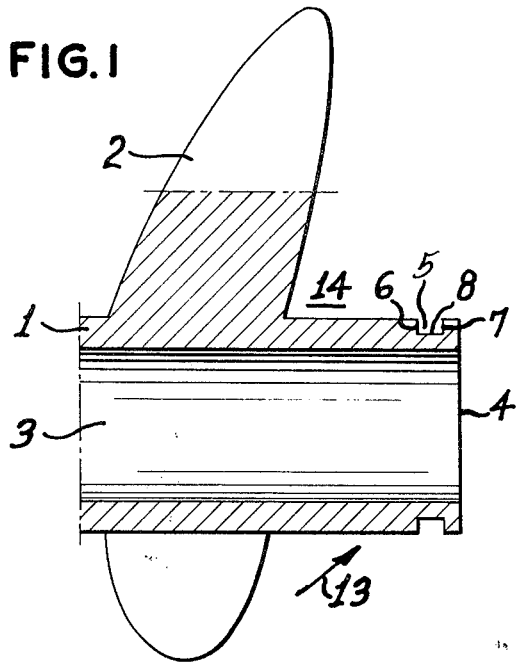
FIG. 1 is a sectional side view of a preferred embodiment of the invention.

In the drawings 1 designates a propeller hub having blades 2 and a passage 3 for the exhaust gases from the engine, this passage terminating at a rearwardly located discharge opening 4. Between the opening 4 and the propeller blades 2 there is made on the outside of the hub 1 an annular groove or cavity 5 girdling the hub and having a rectangular section, forming a front wall 6, a rear wall 7 and a bottom 8. Within the scope of the invention the groove can be made in other sectional forms. Thus the bottom 8 of the groove may be concave or of V shape, or it may be frusto-conical about the hub axis, providing maximum depth of the groove at or adjacent the rear wall 7. According to the invention, the outer hub surface is smooth and fair aft of the blades and a groove is provided in the hub below this surface and opening outwardly through this fair surface. The groove, according to the invention, should have a rear wall 7 which extends substantially radially outwardly, that is, at an angle of 90° with respect to the longitudinal axis of the hub, or which extends outwardly and forwardly, that is, at an angle with respect to the hub axis of less than 90° measured in a forward direction, but which does not extend outwardly and rearwardly. The effectiveness of the groove depends upon a rear wall which restricts the flow of water rearwardly from the groove, and a groove having sufficient depth and width to receive at least a small but significant volume of water. The forward wall is shown as extending radially outwardly, in a plane normal to the hub axis, but this wall may be inclined forwardly or rearwardly as desired. If the bottom wall extends from the bottom of the rear wall forwardly and outwardly, the front wall may disappear with such inclined bottom wall meeting the outer surface of the hub forwardly of the top of the rear wall forming a groove of V shape with the apex of the "V" at the bottom of the rear wall. The rear wall then serves its purpose to restrict the escape of water from the groove or recess which is defined in front of the rear wall. The groove or cavity 5 thus opens outwardly through the smooth and fair hub outer surface.

Figure 2:
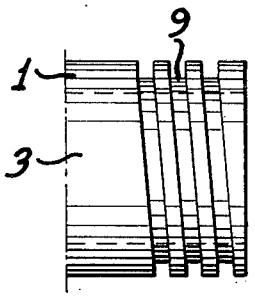
FIG. 2 is a side view of a second embodiment of the invention.

It is also possible to have a plurality of such grooves axially spaced between the discharge opening 4 and the propeller blades 2 or to have, as is shown in FIG. 2, a single groove helically formed having a bottom 9 and extending to a plurality of turns. The turns may be continued forwardly, if desired, up to the base of the propeller blades. The groove or grooves can also be replaced by one or a series of axially spaced annularly extending recesses.

Figure 3:
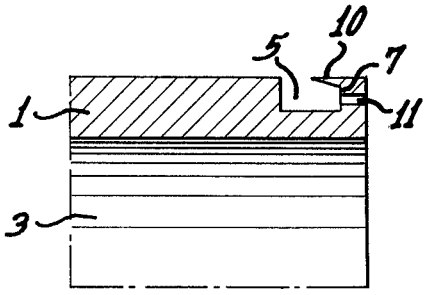
FIGS. 3, 4 and 5 are sectional side views, on an enlarged scale, of other embodiments of the invention.

In FIG. 3 the device is modified such that the rear wall 7 of the groove 5 is provided with a projection in the form of a lip 10 directed towards its front wall 6 and dimensioned shorter than the width of the groove 5. Preferably the outer edge of this projection is tapered. The rear wall 7 may be provided with a plurality of passages 11, terminating at the rear wall of the hub 1.

Passages 11 typically constitute cylindrical bores extending parallel to or at a small angle to the hub axis. In effect, the projection 10 causes the rear wall to extend outwardly and forwardly. The passages 11 permit escape of water from the groove and tend to reduce the amount of water thrown from the groove into the volume of low pressure, as hereinafter explained, yet serve to supply a water shield around the exhaust gases expelled from the hollow hub interior.

Figure 4:
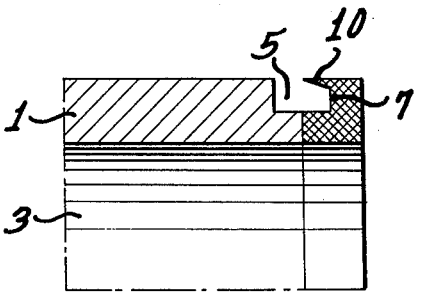

In FIG. 4 the rear wall 7 and the projection 10 have been made of a resilient material having such elasticity properties that it yields slightly under the forces of the flowing water. Alternatively either the wall 7 or the projection 10 can be made of such resilient material.

Figure 5:
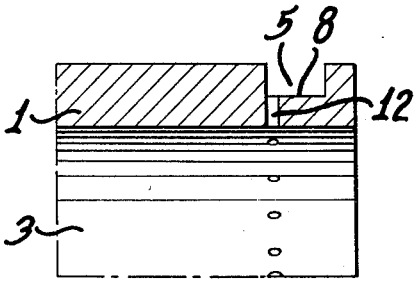

In FIG. 5 is shown a further embodiment of the device generally according to FIG. 1. In this further embodiment the bottom 8 of the groove 5 is connected to the passage 3 through radially extending holes 12.

The holes 12 are not usually to be desired but under some conditions may serve to assist in the release of water from the groove into the volume of reduced pressure. Insofar as holes 12 may permit escape of exhaust gas from the hub interior into such volume, such holes would, however, tend to defeat the purposes of the invention.

The consecutively or intermittently arranged annular recesses can be placed on the outside of the hub 1 or on the outside of an attachment connected to the rear end of the hub or on both the hub and its attachment. Such attachment may, for instance, be a hollow nut.

The various devices described above can be combined with transversal grooves made on the base of the propeller blades. It is also possible within the scope of the present invention to combine any detail, described in connection with the embodiment according to one figure, with other details in the embodiments according to other figures.

The operation of the grooves or recesses is such that the water, when steering the boat by means of the outboard motor or outboard leg, when propelling the boat against heavy waves and when forcing the boat from displacement to planing position, is given a certain angle of incidence towards the propeller hub 1 and by the inventive device is forced to flow in a transverse direction, which flow will constitute an effective barrier to the exhaust gases, so that their migration forwardly along the hub to the front faces of the propeller blades is prevented or reduced. By forming the groove below the normal outer surface of the hub 1, which also applies to the projection 10, harmful effects on the propulsion speed are minimized.

When, during steering or as a result of wave action or otherwise, water flows with respect to the hub and propeller in the direction indicated by arrow 13 (the angle being exaggerated) rather than parallel to the propeller axis, the space generally indicated at 14 which space is partially shielded by the hub, contains water under reduced pressure, and there is a tendency for exhaust gases issuing from the hub opening 4 to migrate forwardly generally along the hub surface into this space or volume of water and to find its way to the front faces of the propeller blades.

According to the invention, water enters the groove generally in the direction of arrow 13 on the higher water pressure side of the hub, that is, at the portion of the hub toward which water is angling, be it the top, bottom, right or left side of the hub, and leaves or is thrown from the groove into the space on the opposite side of the hub then occupied by water under reduced or lower pressure. The water so issuing from the groove presents a barrier to the forward migration of the exhaust gases.

The hub outer surface may be cylindrical, as shown, although it may depart slightly from this shape. The hub, as is well known, should present a smooth surface extending in the direction of normal water flow past or along the hub when the boat is being propelled straight ahead at high speed thereby to minimize drag. Whether hub should be of slightly reducing or slightly increasing diameter rearwardly of the propeller blades is a compromise between drag and exhaust back pressure.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the U.S. is:

1. A marine propeller having a hub with a hollow interior passage terminating at a rearwardly located discharge opening for passage of exhaust gases into the water and with a plurality of propeller blades extending outwardly from said hub spacedly forwardly of said opening, said hub rearwardly of said blades having a smooth outer surface extending in the direction of normal water flow during straight ahead high speed propulsion, said propeller being characterized by a hub-girdling groove disposed spacedly between said blades and said rearward opening, said groove opening outwardly through said hub surface and defined by a rear groove wall, said groove having a bottom located inwardly of said surface and said rear wall extending outwardly from the bottom of said groove toward said surface at an angle with respect to the hub axis not greater than 90° as measured in a forward direction.

2. A marine propeller in accord with claim 1 wherein more than one such groove is located along the portion of said hub surface between said blades and said rearward opening.

3. A marine propeller in accord with claim 1 wherein said groove rear wall extends circularly around said hub.

4. A marine propeller in accord with claim 1 wherein said groove defines a helix of at least one full turn around and along said hub.

5. A marine propeller in accord with claim 1 wherein said groove is rectangular in cross section.

6. A marine propeller in accord with claim 3 wherein said groove is rectangular in cross section.

7. A marine propeller in accord with claim 4 wherein said groove is rectangular in cross section.

8. A marine propeller in accord with claim 1 wherein the upper end portion of said rear wall is in the form of a forwardly extending annular lip partially closing the entrance into said groove.

9. A marine propeller in accord with claim 8 wherein said lip tapers in cross section forwardly from said rear wall.

10. A marine propeller in accord with claim 8 wherein said lip is resilient.

11. A marine propeller in accord with claim 8 wherein said groove is defined by a front wall lying in a plane normal to the hub axis.

12. A marine propeller in accord with claim 1 wherein said wall is of resilient material.

13. A marine propeller in accord with claim 1 wherein the width of the opening through said surface into said groove is less than the maximum width of said groove inwardly of said surface.

14. A steerable marine propeller having a hub with a hollow interior passage terminating at a rearwardly located discharge opening for passage of exhaust gases into the water and with a plurality of propeller blades extending outwardly from said hub spacedly forwardly of said opening, said hub rearwardly of said blades having a fair outer surface extending in the direction of normal water flow during straight ahead high speed propulsion, said propeller being characterized by means defining an annular cavity girdling said hub having a bottom disposed inwardly of said surface and opening outwardly through said outer surface of said hub, said means including rear wall extending outwardly from said bottom, said cavity being operative to receive water thereinto through said opening at one side of the hub when the hub is subjected to water flow toward such side, such as during steering, and to release water so received from the cavity on the opposite side of the hub.

15. A marine propeller in accord with claim 14 wherein said cavity has a closed bottom and a rearward end wall and is in part defined inwardly of an annular lip extending forwardly from said rearward end wall, said lip having an outer surface substantially fair and flush with said outer surface of said hub, said lip terminating forwardly in an edge defining the rearward side of such opening.

16. A marine propeller in accord with claim 14 wherein said cavity has a closed bottom and a rearward end wall and is in part defined inwardly of an annular resilient lip extending forwardly from said rearward end wall, said lip having an outer surface when at rest substantially fair and flush with said outer surface of said hub, said lip being yieldable from its at rest shape under the forces of flowing water and terminating forwardly in an edge defining the rearward side of such opening.

* * * * *